US010730067B2

(12) United States Patent
Levy et al.

(10) Patent No.: US 10,730,067 B2
(45) Date of Patent: Aug. 4, 2020

(54) DEVICE AND METHOD FOR THE ODORISATION OF A GAS CIRCULATING IN A PIPELINE

(71) Applicant: ENGIE, Courbevoie (FR)

(72) Inventors: Cyrille Levy, Ozoir la Ferriere (FR); Amelie Louvat, La Chapelle en Serval (FR); Louis Gorintin, Montrouge (FR); Julien Guillet, Paris (FR)

(73) Assignee: ENGIE, Courbevoie (FR)

( * ) Notice: Subject to any disclaimer, the term of this patent is extended or adjusted under 35 U.S.C. 154(b) by 32 days.

(21) Appl. No.: 16/083,498

(22) PCT Filed: Mar. 8, 2017

(86) PCT No.: PCT/FR2017/050512

§ 371 (c)(1),
(2) Date: Sep. 8, 2018

(87) PCT Pub. No.: WO2017/153682

PCT Pub. Date: Sep. 14, 2017

(65) Prior Publication Data

US 2019/0070627 A1 Mar. 7, 2019

(30) Foreign Application Priority Data

Mar. 8, 2016 (FR) ..... 16 51905

(51) Int. Cl.
*B05B 17/00* (2006.01)
*B05B 7/00* (2006.01)

(52) U.S. Cl.
CPC ..... *B05B 17/0638* (2013.01); *B05B 7/0075* (2013.01)

(58) Field of Classification Search
CPC ..... B05B 17/063; F17C 2265/027
See application file for complete search history.

(56) References Cited

U.S. PATENT DOCUMENTS

2005/0112020 A1* 5/2005 Zeck ..... G05D 11/132 422/4
2016/0115407 A1* 4/2016 Cagnon ..... B01F 5/0485 137/1

FOREIGN PATENT DOCUMENTS

GB 2177623 A * 1/1987 ..... B05B 17/0638

* cited by examiner

*Primary Examiner* — Matthew J Merkling
(74) *Attorney, Agent, or Firm* — Patshegen IP LLC; Moshe Pinchas

(57) ABSTRACT

The invention relates to a device (100) for the odorization of a gas circulating in a pipeline (200), comprising:

- a tank (105) for a liquid odorizing compound;
- a means for detecting (140) differences in pressure between the pipeline (200) and the tank;
- a means (135) for pressurizing the compound in the tank according to the pressure difference;
- a microperforated membrane (110) acting as an interface between the tank and an inner volume (115) of the pipeline; and
- a means (120) for vibrating the microperforated membrane in order to spray the liquid odorizing compound, when it comes into contact with the membrane, into the pipeline.

21 Claims, 3 Drawing Sheets

DEVICE AND METHOD FOR THE ODORISATION OF A GAS CIRCULATING IN A PIPELINE

TECHNICAL FIELD OF THE INVENTION

The present invention relates to a device and method for the odorization of a gas circulating in a pipeline. It applies, in particular, to the odorization of biomethane and natural gas.

STATE OF THE ART

Most combustible gases have no odor. Because of their potentially dangerous nature, current regulations require the addition of an odorizing compound in natural gas pipelines so it can be detected by its odor. Blended or pure odorizing compounds, such as tetrahydrothiophene (referred to under the acronym "THT") or tert-butyl mercaptan (referred to under the acronym "TBM"), are generally used for this odorization operation.

The systems for injecting an odorizing compound in liquid form into a natural gas pipeline are generally sized to be efficient at the maximum gas flow rate observable at the injection point and at a stabilized flow rate.

However, the odorizing compound injection systems known from the prior art can become less efficient when the actual gas flow rate becomes lower than this maximum flow rate, which can result in defective gas odorization.

In addition, these observed variations in the gas flow rate in the pipelines are even larger when the maximum flow rate of the gas to be odorized is low, as may be the case in particular for biomethane injection points or gas distribution stations. Furthermore, the opening up of gas markets to competition has resulted in the observation of an increasingly large variability in the amplitude and frequency of the observable flow rates of gas even at the interconnection points of the major gas transport networks.

In some cases, the appearance of puddles can be observed, which are caused by spraying droplets that are too large, reaching the bottom of the pipeline before they have evaporated and then accumulating there in the liquid state. The sprayers generate droplets with a diameter of up to one hundred micrometers.

In other current systems, diffusers impregnated with odorant are utilized. The accumulation of liquid odorant in the impregnator can generate over-odorization when the gas flow starts and stops; in the context of injecting biomethane in the network, this can delay the resumption of the injection for up to several hours and constitute a loss of revenue for the producer.

There are in particular other systems of injection by evaporation, in which a portion of the gas to be odorized is taken from the main stream and put in contact with the liquid odorizing compound, which it evaporates until thermodynamic equilibrium is obtained. This bypass stream is then mixed with the main stream to obtain a mixture containing the desired proportion of odorizing compound.

Another known system is that of injection pump systems in which the liquid odorizing compound is injected directly into the gas pipeline by means of a pump, for example a diaphragm pump, or by injecting the odorizing compound by pressurized gas. The liquid odorizing compound is evaporated in the gas by using an injection tube comprising a porous material or after a coarse spray.

For the last two systems described above, different types of odorizer can be utilized such as, for example:

- by contact evaporation of the odorizing compound from the storage tank:
  - wick odorizer,
  - evaporation bypass odorizer, and
  - pulse bypass odorizer;
- by injection:
  - gaseous piston odorizer,
  - mechanical pump odorizer,
  - injection tube,
  - "fogging" system, or spraying/misting under pressure; and
  - ultra-high-pressure injection, known as "common rail", as described in patent FR 13 55338.

The techniques of odorization by contact evaporation of the odorizing compound from the storage tank are used to odorize low gas flow rates. They are hardy and have the advantage of not requiring a supply of energy. They are suitable for the use of pure odorizing compounds or of those whose constituents have similar vapor pressures, since the odorizing compound passes into the gas by evaporation. The use of a mixture of products having very different vapor pressures may result in distillation phenomena and lead to the depletion of the liquid fraction for a constituent and therefore a change in the odorization quality over time. It is mainly for this type of odorizer that odorizing compounds having a high vapor pressure need to be used, because this makes it possible to limit variations in the concentration of odorizing compound when the gas or outside temperature varies.

There are three types of evaporation odorizer: wick, evaporation bypass and pulse bypass.

Wick odorizers are used mainly in the United States for very low flow rates, typically for the supply to an isolated house. A wick is immersed in the tank of odorizing compound, fixed directly in the pipeline, and emerges in the gas flow. The odorizing compound circulates in the wick by capillary action and evaporates in the gas flow. The main problems with this type of odorizers are linked to the wick being clogged by oils or greases brought by the gas. In addition, gas flow rates that are too high, especially if accompanied by low temperatures, significantly reduce the evaporation rate, which can result in cases of under-odorization.

Evaporation bypass odorizers are used when the flow rate of the gas to be odorized is fairly low, typically the consumption of a small town. Their operation depends on the installation of a pressure-reducing unit, such as an orifice plate, in the pipeline of the gas to be odorized. Taps on either side of this obstacle make it possible to communicate with the tank of odorizing compound. A regulating valve located on one of the taps makes it possible to adjust the load loss of the bypass circuit. Thus, the flow rate of gas passing via the tank of odorizing compound is a function of the load loss in the main pipeline and thus of the main gas flow rate. If the exchange surface of the tank of odorizing compound is sufficient, the gas that exits from it is saturated with odorizing compound and will be able to odorize the main stream at a constant level by mixing. The main problems with this type of odorizer are linked to:

- temperature variations in the odorizing compound, which lead to variations in saturation vapor pressure and thus in the concentration of odorizing compound in the saturated gas; and
- operation at a low flow rate, with the load loss created by the pressure-reducing unit possibly becoming insufficient, such that the stream circulating in the tank of odorizing compound is substantial.

Lastly, the risk exists of the odorizing compound being contaminated by products transported by the gas that circulates in the tank of odorizing compound. Its olfactory qualities can be impacted, or surface deposits can reduce its evaporation rate and result in under-odorization.

The techniques of odorization by injection consist of transporting the liquid odorizing compound to the pipeline where it evaporates in the main gas flow. The gas, except if it is used to pressurize the odorizing compound, is therefore no longer in contact with the odorizing compound in the storage tank. The installation can therefore be separated into three parts:

- a tank of odorizing compound, which may be at atmospheric pressure or at slight overpressure to prevent contact with the air, which can lead to pollution by dust or water,
- a pressurization system, such as a pump, for example, controlled by a gas flow measurement; and
- a device enabling contact between the liquid odorizing compound and the gas.

This type of installation is suitable for any type of flow rate. It enables good control of the odorization over a fairly large operating range. It can be used with all the odorizing compounds available in the market. One of its advantages is that the tank of odorizing compound does not need to be at the pressure of the gas. However, it requires an electrical power supply and measuring the gas flow rate, therefore the installation of a metering device.

There are three types of injection odorizers: gaseous piston, mechanical pump, injection tube.

In the case of a gaseous piston odorizer, the liquid odorizing compound is injected by using the pressure of the gas upstream from the pressure reducing station. The tank of odorizing compound is pressurized to a fairly high pressure above that of the gas to be odorized, and a mass flow regulator is controlled directly as a function of the flow rate of the gas to be odorized. This solution can nevertheless pose problems at low flow rate, when it becomes difficult to control the flow rate of the odorizing compound. It also requires the tank of odorizing compound to be pressurized to a fairly high level to overcome the load losses of the tank.

In their simplest version, pump odorizers are equipped with a device measuring the flow rate of the gas to be odorized, a pump, and a controller coupling the pump's flow rate to the gas flow rate. These installations enable a very stable odorization of the gas. However, given the reduction in the pumping frequency, the following can be observed at very low flow rates:

- pump unpriming, if pumps are oversized; and
- poor vaporization and poor entrainment of the odorizing compound in the gas.

In the largest odorization installations of this type, the odorizing compound content is measured downstream from the injection point so as to close the feedback loop and correct any system drift. The odorizing compound content can be measured twice, once upstream and once downstream from the injection point. This particular configuration is necessary for odorizing gas coming from an underground reservoir. The odorizing compound content of gas taken from aquifer storage can vary rapidly over a large range. It is therefore necessary to supplement its odorization as needed. Measuring the content upstream makes it possible to determine the quantity of odorizing compound to be injected into the gas to achieve this supplement and quickly modify the injection set point. Measuring the content downstream helps to ensure good regulation. Using only the downstream measurement of the odorizing compound content does not enable a correct regulation to be achieved, because of the response times and the imprecision of the measuring instruments.

In the injection tube systems, since the odorizing compound arrives in the gas pipeline as a liquid, its evaporation has to be fostered. Some installations achieve this by having the tube delivering the odorizing compound emerge at an upper generatrix of the pipeline. In this case, the odorizing compound drips and evaporates as it falls on the wall. If evaporation is not fast enough, a puddle can form, which can lead to fluctuations in the concentration depending on the flow rate. The evaporated odorizing compound flow is linked to the surface of the puddle, at equal temperature, and therefore changes slowly whereas the gas flow rate can vary significantly.

The evaporation systems require the supply of liquid odorizing compound to be kept at the pressure of the gas circulating in the pipeline, which poses clear regulatory problems. Furthermore, contact between the odorizing compound and the natural gas causes pollution of the odorizing compound with possible solubilization of the gas compounds in the odorizing compound, which can impair the latter's quality. Lastly, the physical principle of these systems leads to great variability in the odorizing compound content in the gas if the ambient temperature changes (the saturation vapor pressure being a function of temperature). This physical principle is also very poorly suited to the use of odorizing compounds consisting of a combination of products, such as TBM in particular.

The injection and pump systems inject a fixed quantity of odorizing compound each time the pump is actuated. In particular, when the gas flow rate in the pipeline becomes very low, the pump's actuation frequency is reduced, which leads to the system not operating continuously. However, the absence of backpressure between two successive actuations of the pump results in its unpriming if the pump has the slightest loss of tightness. In addition, injecting a large quantity of odorizing compound at each actuation of the pump in a very low gas flow rate leads to poor evaporation of the odorizing compound.

These pump and injection systems can also generate non-compliant odorization during sudden variations in flow rate:

- spraying (injection system): in some cases, under-odorization can occur at low flow rates (the odorant can hit the wall and accumulate as a puddle in the pipeline instead of being vaporized in the gas); similarly, over-odorization can occur when the gas flow rate increases (turbulence boosting evaporation of the puddle) before stabilizing at the compliant concentration,
- impregnator-based diffusion (pump system): the liquid odorant accumulates in the impregnator; when the flow is cut off, the odorant can drip and create an over-odorization when the flow resumes, and
- high-pressure injection system: this system is potentially precise and reactive, and it would probably resolve odorization non-compliance when there are variations in the flow. However, it contains many complex elements, including a high-pressure pump and a head whose opening is controlled by a piezoelectric element; testing and any changes to these elements may be complicated and costly; the final cost of the product can be high.

SUBJECT OF THE INVENTION

The present invention aims to remedy all or part of these drawbacks.

To this end, according to a first aspect, the invention envisages a device for the odorization of a gas circulating in a pipeline, which comprises:

- a tank for a liquid odorizing compound;
- a means for detecting differences in pressure between the pipeline and the tank;
- a means for pressurizing the compound in the tank according to the pressure difference;
- a microperforated membrane acting as an interface between the tank and an inner volume of the pipeline; and
- a means for vibrating the microperforated membrane in order to spray the liquid odorizing compound, when it comes into contact with the membrane, into the pipeline.

The membrane, by vibrating, extrudes the liquid present against one of its surfaces, and passes this liquid to the other side of the membrane in the form of droplets. The vibrations of the membrane eject the droplets that have passed through the membrane so as to form a cloud of microdroplets. The device that is the subject of the invention therefore functions as an odorant nebulizer.

These provisions produce the following advantages:

- the fineness of the droplets, compared to conventional sprayers, makes it possible to improve the density of the liquid/gas interface and therefore the vaporization kinetics;
- control over the size of the droplets means variability of the odorization can be prevented;
- the device is suitable for any odorization system with regard to gas flow rate;
- vaporization is precise and instantaneous, the size of the nebulized drops may be of the order of four micrometers, compared to five to 100 micrometers for conventional sprayers, which makes it possible to prevent the creation of puddles in the pipeline;
- as the speed of emission is reduced, the odorizing compound is not projected against the opposite wall of the pipeline;
- adjustment of the mechanical stress exerted by the compound on the membrane, according to the ratio of the pressure in the pipeline and in the tank, enables the operation of the device to be optimized.

In some embodiments, the means for pressurizing the compound keeps the pressure in the tank of compound below or equal to the pressure in the pipeline.

In some embodiments, the means for pressurizing the compound keeps the pressure in the tank of compound below the pressure in the pipeline.

The general practice of the person skilled in the art is to use an odorization system at a higher pressure than that of the pipeline, so as to facilitate the transfer of the odorizing compound from the tank to the pipeline. The inventors have discovered, on the contrary, that a lower pressure in the tank than that of the pipeline is favorable to achieving the odorization envisaged. Therefore, contrary to the usual technical bias, the unusual utilization of a negative pressure difference between the tank and the pipeline enables a better operation of the device, in a stationary process and when the membrane is put into operation.

In some embodiments, the device that is the subject of the invention comprises a means for coupling the pressure inside the tank to the gas flow rate in the pipeline.

In some embodiments, the coupling means is configured so that the pressure difference is, in absolute value, a decreasing function of the gas flow rate in the pipeline.

It has been observed that this reduction in pressure difference in the tank of odorizing compound when the flow rate increases allows good regulation of the level of compound in the gas. In addition, the large pressure difference when the flow rate is zero makes it possible to reduce, even prevent, the passage of the odorizing compound.

In some embodiments, the device that is the subject of the invention comprises a vent connected to the tank, the opening and closing of this vent being controlled by the pressurization means as a function of the pressure difference.

These embodiments allow the pressure to be reduced inside the tank.

In some embodiments, the device that is the subject of the invention comprises a conduit connecting the vent to the tank, the link between the tank and the conduit being achieved by an opening positioned on an upper portion of the tank so as to be positioned with regard to a gaseous phase contained in the tank.

These embodiments allow the pressure to be reduced inside the tank by extracting the gaseous phase above the odorizing compound.

In some embodiments, the device that is the subject of the invention comprises a gas conduit connecting the pipeline to the tank, the opening and closing of this conduit being controlled by the pressurization means as a function of the pressure difference.

These embodiments allow the pressure to be increased inside the tank by adding gas passing through the pipeline in this tank.

In some embodiments, the means for detecting differences in pressure detects a pressure difference between the interior of the conduit connecting the pipeline to the tank and the conduit connecting the tank to the vent.

In some embodiments, the means for pressurizing the compound keeps the compound at a pressure at least 50 millibars below the pressure of the pipeline.

In some embodiments, the means for pressurizing the compound keeps the compound at a pressure at least 100 millibars below the pressure of the pipeline.

In some embodiments, the device that is the subject of the invention comprises:

- a sensor detecting the gas flow-rate in the pipeline; and
- a calculator of a quantity of odorizing compound to be nebulized as a function of the flow rate measured, the vibration means being configured to vibrate the membrane as a function of the quantity calculated.

These embodiments have the advantage of making the device adaptable to the gas flow-rate, odorization being regulated as a function of the gas flow rate passing through the pipeline.

In some embodiments, the device that is the subject of the invention comprises a means for measuring the temperature of the odorant and/or the gas, the vibration means being actuated as a function of the temperature measured.

These embodiments make it possible to reduce the influence of the temperature on the viscosity of the odorant affecting its capacity to be extruded by the membrane.

In some embodiments, the device that is the subject of the invention comprises a means for measuring the pressure of the gas, the vibration means being actuated as a function of the pressure measured.

In some embodiments, the device that is the subject of the invention comprises a means for measuring characteristics of the electrical signal of the power supply system for the membrane (frequency, duty cycle, amplitude and/or direct voltage component at the terminals of the membrane and/or the intensity of the current circulating through the membrane), the vibration means being actuated as a function of these characteristics.

It has been observed that the voltage and intensity vary as a function of the temperature: instead of regulating the vibration means as a function of temperature, pressure, concentration, it can be envisaged to utilize electrical regulation, which stabilizes the voltage or current applied to the vibration means and maintains it at the appropriate level.

In some embodiments, the device that is the subject of the invention comprises a means for measuring the concentration of the odorant downstream from the membrane, the vibration means being actuated as a function of the concentration measured.

In some embodiments, the membrane is positioned against a lower portion of the tank.

These embodiments make possible a realization without additional means for contact between the membrane and the odorizing compound, this playing a role in limiting the energy requirements of the device.

In some embodiments, the device that is the subject of the invention comprises a flowmeter measuring the flow rate of odorant passing through the supply conduit.

In some embodiments, the device that is the subject of the invention comprises:

a malfunction detector for the device; and a mechanism for closing a conduit supplying the tank with odorizing compound.

These embodiments prevent any inflow of gas in the odorizing compound supply system if the membrane ruptures.

In some embodiments, the device that is the subject of the invention comprises a plurality of microperforated membranes.

These embodiments make it possible to increase the maximum nebulization flow rate of the device and make it easier to maintain or replace the system.

In some embodiments, the vibration means is a piezoelectric crystal.

In some embodiments, the vibration means and the membrane are one and the same.

In some embodiments, the device that is the subject of the invention comprises a filter on the conduit supplying the tank with odorizing compound.

In some embodiments, the system supplying the tank with odorizing compound comprises a pump.

In some embodiments, the system supplying the tank with odorizing compound comprises an intermediate tank and solenoid valves.

These embodiments make it possible to increase the pressure of the odorizing compound to the level of the pressure of the pipeline and to circulate the odorizing compound from the odorizing compound storage to the tank.

In some embodiments, the device that is the subject of the invention comprises a tube or sleeve comprising each membrane and connected to the tank such that the odorizing compound comes into contact with each membrane.

These embodiments make it possible to attach the device to the pipeline without carrying out work on the pipeline.

According to a second aspect, the invention envisages a method for the odorization of a gas circulating in a pipeline, which comprises:

a step of filling a tank with liquid odorizing compound;

a step of detecting differences in pressure between the pipeline and the tank;

a step of pressurizing the compound in the tank according to the pressure difference;

a step of vibrating a microperforated membrane acting as an interface between the tank and an inner volume of the pipeline; and a step of nebulizing the odorizing compound, when it comes into contact with the membrane, in the pipeline.

As the particular aims, advantages and features of the method that is the subject of the invention are similar to those of the device that is the subject of the invention, they are not repeated here.

BRIEF DESCRIPTION OF THE FIGURES

Other advantages, aims and particular features of the invention will become apparent from the non-limiting description that follows of at least one particular embodiment of the device and method that are the subjects of the invention, with reference to drawings included in an appendix, wherein.

DESCRIPTION OF EXAMPLES OF REALIZATION OF THE INVENTION

The present description is given in a non-limiting way, each characteristic of an embodiment being able to be combined with any other characteristic of any other embodiment in an advantageous way.

It is now noted that the figures are not to scale.

It is also noted that the gas circulating in the gas pipeline 200 is, for example, biomethane, natural gas or hydrogen produced by a method of converting electrical energy into gas, known as "power to gas".

The pipeline 200 corresponds to any gas transport pipeline of a gas supply network from a gas production unit to a gas consumption unit.

The term "odorizing compound" refers, for example, to pure products (THT), mixtures based on sulphur compounds (TBM, mercaptans, sulfides) or mixtures based on acrylates (Gasodor S-Free from Symrise (registered trademarks)). The advantage of using the system is that this compound passes to the gaseous state almost instantly during the utilization of the device that is the subject of the invention. This rapidity of change of state eliminates the risk of creating a puddle even at a low flow rate, or the risk of over-odorization in a transient regime.

Figure 1:
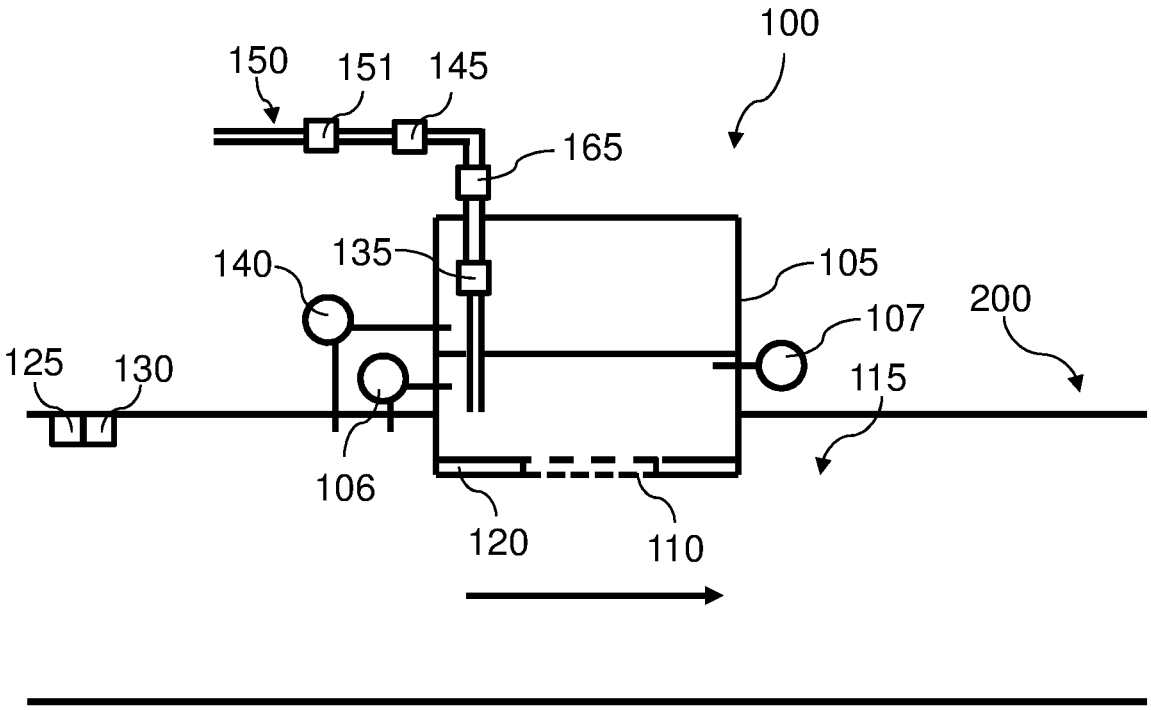
FIG. 1 represents, schematically, a first particular embodiment of the device that is the subject of the invention.

FIG. 1, which is not to scale, shows a schematic view of an embodiment of the device 100 that is the subject of the invention. This device 100 for the odorization of a gas circulating in a pipeline 200 comprises:

a tank 105 for a liquid odorizing compound;

a means for detecting 140 differences in pressure between the pipeline 200 and the tank;

a means 135 for pressurizing the compound in the tank according to the pressure difference;

a microperforated membrane 110 acting as an interface between the tank and an inner volume 115 of the pipeline 200; and a means 120 for vibrating the microperforated membrane in order to spray the liquid odorizing compound, when it comes into contact with the membrane, into the pipeline 200.

The membrane 110 is, for example, a microperforated membrane configured to form droplets of odorizing compound with a diameter preferably between four and six micrometers.

The membrane 110 can be vertical, horizontal or oblique.

The system for attaching the membrane 110 holds the membrane firmly to ensure the seal between the odorant and the pipeline 200 while being flexible enough to not unduly constrain the membrane nor prevent it vibrating.

This membrane 110 is preferably configured to withstand a pressure of eighty-five bars.

This membrane 110 is preferably configured to nebulize 0.3 to 2400 normal cubic meters per hour when the droplets have a diameter of four micrometers.

In some particular embodiments, such as that shown in FIG. 1, the membrane 110 is positioned against a lower portion of the tank 105, contact between the compound and the membrane 110 being ensured, for example, by gravity.

In other embodiments, the membrane is vertical, and contact between the compound and the membrane is ensured by pressurizing the compound.

Figure 2:
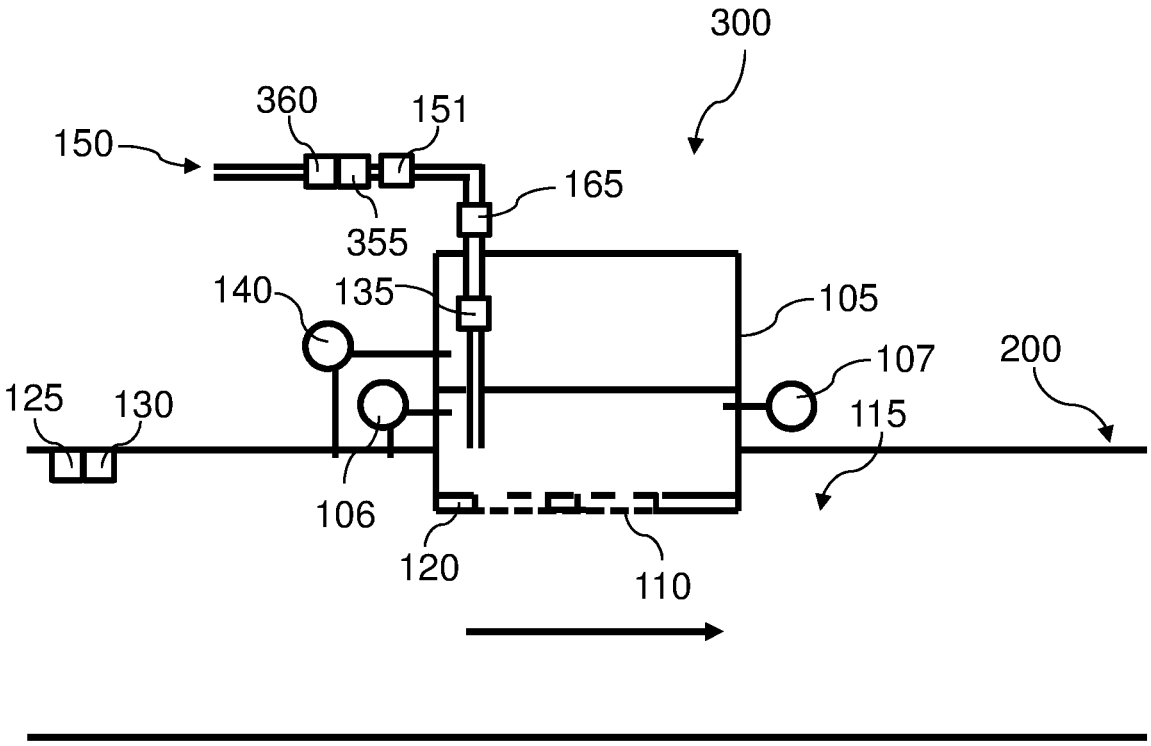
FIG. 2 represents, schematically, a second particular embodiment of the device that is the subject of the invention.

In some preferred embodiments, such as that shown in FIG. 2, the device 300 comprises a plurality of membranes 110. In a configuration in which the device 300 comprises seven membranes producing droplets twenty micrometers in diameter, the device 300 nebulizes between two hundred and two million normal cubic meters per hour.

The vibration means 120 is, for example:

a magnetic or mechanical mechanism for vibrating the membrane 110;

a piezoelectric crystal mechanism; and/or an ultrasound mechanism as described in patent FR 2908329, included here as reference.

The vibration means 120 and the membrane 110 are preferably one and the same, the membrane 110 itself serving as vibration means 120. For example, the membrane 110 can be formed of a piezoelectric element, and the membrane serves both as interface between the tank and the pipeline 200 and as vibration means 120.

Such membranes are described in the following documents:

DE102005005540,

WO2012020262 or

EP2709769.

The vibration means 120 is, for example, configured to create vibrations of the membrane 110 with a frequency of between ten and one hundred thousand Hertz.

In some preferred embodiments, such as that shown in FIG. 1, the device 100 comprises:

a sensor 125 detecting the gas flow rate in the pipeline 200; and a calculator 130 of a quantity of odorizing compound to be nebulized as a function of the flow rate measured, the vibration means 120 being configured to vibrate the membrane 110 as a function of the quantity calculated.

The sensor 125 is, for example, a flowmeter from amongst all the known types of flowmeters.

The calculator 130 is, for example, an electronic circuit connected to the gas flow-rate sensor 125 by a wired or wireless link to receive from it a value representative of the flow rate measured.

Using a predefined mathematical formula, this calculator 130 calculates the quantity of compound to the nebulized.

The calculator 130 is connected by a wired or wireless link to the vibration means 120 of the membrane 110 and sends a value representative of the quantity calculated.

The vibration means 120 determines, from the value of the calculated quantity received:

an amplitude value for the vibration of the membrane 110;

a duration for the vibration of the membrane 110; and/or a frequency for the vibration of the membrane 110.

The pressurization means 135 is, for example:

a pump; and/or a passive pressure balancing mechanism.

A passive pressure balancing mechanism comprises, for example, a mobile piston at the interface between the gas and the liquid. In general, any mechanism that enables a variation in the volume of the tank under the action of the pressurized gas can be utilized.

As indicated above, the device 100 comprises a means 140 for detecting the difference between the pressure of the gas in the pipeline 200 and the pressure inside the tank 105, the pressurization means 135 being controlled according to the pressure difference.

The means for detecting differences in pressure 140 is, for example, a differential pressure gauge connected by a wired or wireless link to the pressurization means 135. It is noted that this means for detecting differences in pressure 140 can comprise two pressure sensors, one located in the tank and the other in the gas pipeline, or comprise a single sensor positioned at an interface between the tank and the pipeline. In some embodiments, the means for detecting differences in pressure 140 emits an electric signal representative of the pressure difference. In some embodiments, the means for detecting differences in pressure 140 sends a mechanical force resulting from the pressure difference in question.

The pressurization means 135 thus comprises, preferably, an electronic command circuit (not shown) configured to pressurize the odorizing compound according to a pressure determined as a function of the pressure difference detected by the means for detecting differences in pressure 140.

This determined pressure, for example, substantially corresponds to the pressure detected in the pipeline 200 by the pressure sensor 140. In some preferred variants, the determined pressure is lower than the pressure in the pipeline 200. Preferably, the pressure in the tank 105 is maintained at a pressure at least 50 millibar, and preferably at least 100 millibar, lower than the pressure in the pipeline 200.

Preferably, the pressure in the tank is regulated and coupled to the gas flow rate in the pipeline. Preferably, the pressure difference is, in absolute value, a decreasing function of the gas flow rate in the pipeline. For example, a pressure difference of 50 or 100 mbar in steady state is applied, and this pressure difference is increased to 300 mbar when the gas flow rate of the pipeline becomes zero.

Figure 6:
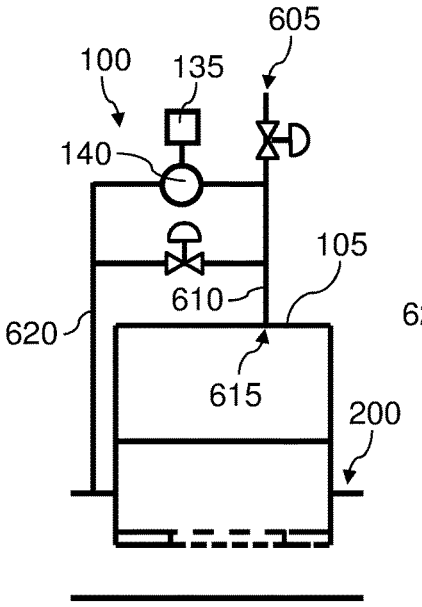
FIG. 6 represents, schematically, a fourth particular embodiment of the device that is the subject of the invention.
Figure 7:
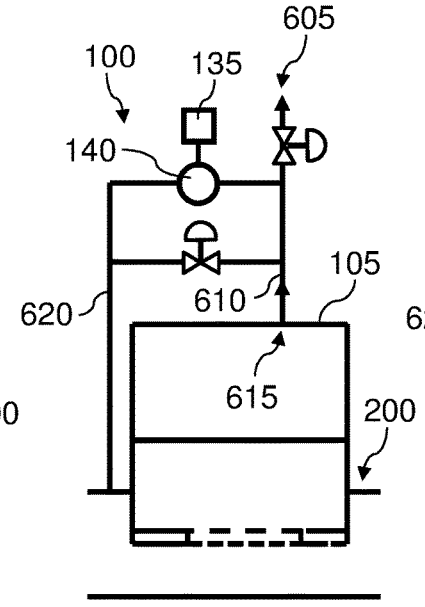
FIG. 7 represents, schematically, the fourth particular embodiment of the device that is the subject of the invention.
Figure 8:
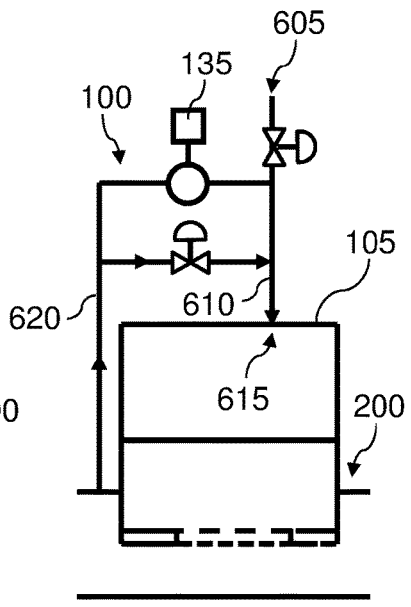
FIG. 8 represents, schematically, the fourth particular embodiment of the device that is the subject of the invention.

Another operating variant of the pressurization of the tank 105 is described with respect to FIGS. 6 to 8.

In some embodiments, the device 100 comprises a flowmeter 151 on the conduit 150 supplying the tank 105 with odorizing compound.

In some preferred embodiments, such as that shown in FIG. 1, the device 100 comprises a non-return valve 145 positioned on the conduit 150 supplying the tank 105 with odorizing compound. The non-return valve is positioned downstream from the flowmeter 151 to protect it from a possible return.

The odorizing compound is supplied by gravity or by utilizing a pump circulating the compound from a tank (not shown) of odorizing compound.

For example, a syringe pump, a gear pump or a peristaltic pump is used. The advantage of the syringe pump is to make it possible to circulate a reduced odorizing compound flow rate while generating a great pressure difference, unlike other types of pump for which, in general, a reduced flow rate corresponds to a low pressure, and a great pressure difference corresponds to a high pressure.

In some preferred embodiments, such as that shown in FIG. 2, the device 100 comprises:

- a detector 355 of a malfunction of the device 100; and
- a mechanism 360 for closing a conduit 150 supplying the tank with odorizing compound.

The detector 355 is, for example, a mechanical detector of a direction of circulation of the odorizing compound, or of the gas to be blocked, in the supply conduit 150. While the odorizing compound circulates in a first direction, corresponding to supplying odorizing compound from the tank 105, the closing mechanism 360 is inhibited. As soon as the odorizing compound, or the gas introduced into the tank 105 following a breakdown of the pressurization pump, circulates in a second direction opposite to the first direction, the detector 355 actuates the closing mechanism 360.

In some variants, the detector 355 measures the mechanical impedance of the membrane 110. A rupture of the membrane 110 is detected when the impedance measures passes a predefined limit value or experiences a significant variation greater than a predefined variation.

In some variants, the detector 355 is a calculator measuring a difference between a vaporization flow rate setpoint value sent to the vibration means and the flow rate of odorant actually passing through the membrane, measured by:

- a flowmeter on the odorant supply system; or
- a level measurement in the tank higher than the membrane 110.

The mechanism 360 for closing the conduit is, for example, a shut-off valve.

These two examples have the effect of blocking the circulation of fluid in the conduit 150, irrespective of whether this fluid is gas or odorizing compound.

In some preferred embodiments, such as that shown in FIG. 1, the device 100 comprises a filter 165 at the interface between the tank 105 and the membrane 110.

This filter eliminates any particles present in the odorizing liquid, to prevent the risks of clogging micro-perforations of the membrane; the filter can have a filtration limit between 0.5 and 4 μm for example.

Figure 3:
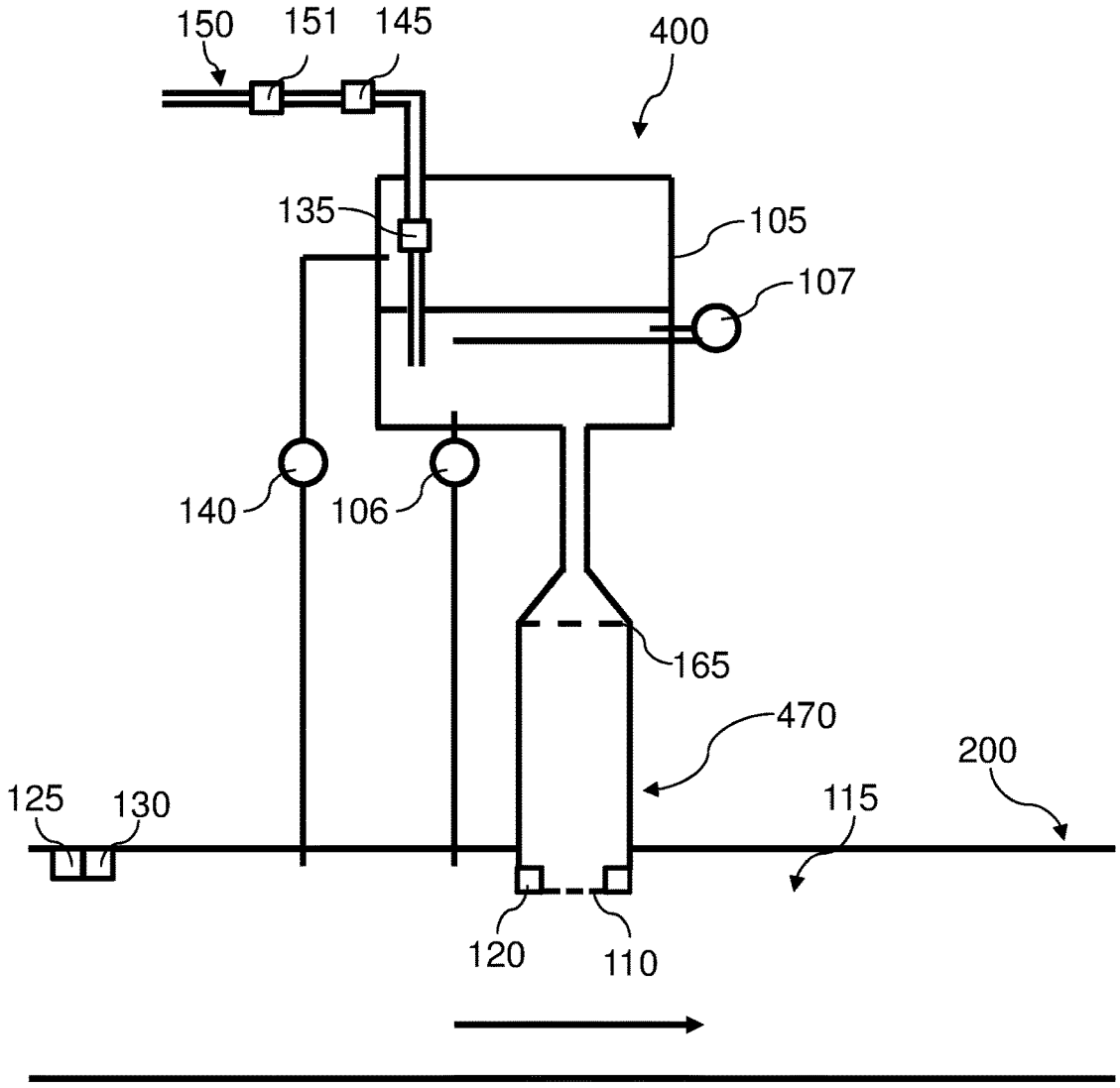
FIG. 3 represents, schematically, a third particular embodiment of the device that is the subject of the invention.

In some preferred embodiments, such as that shown in FIG. 3, the device 400 comprises a tube 470 or sleeve comprising each membrane 110 and connected to the tank 105 such that the odorizing compound comes into contact with each membrane 110.

The sleeve enables attachment via a flange mount of the pipeline 200. However, the flange requires the sectioning and replacement (not shown) of a part of the pipeline 200.

The tube 470 comprises a means for screwing onto an aperture of the pipeline 200 such as, for example, an aperture specifically for the insertion of impregnators on biomethane odorization plants utilized today.

In some particular embodiments, several devices, 100, 300 or 400, are positioned in parallel on the pipeline 200.

In some particular embodiments, the device, 100, 300 or 400, is retractable when in use to facilitate its maintenance.

In some particular embodiments, the device, 100, 300 or 400, is incorporated into a wall of the pipeline 200 such that the membrane 110 is positioned in the extension of the pipeline 200.

Figure 4:
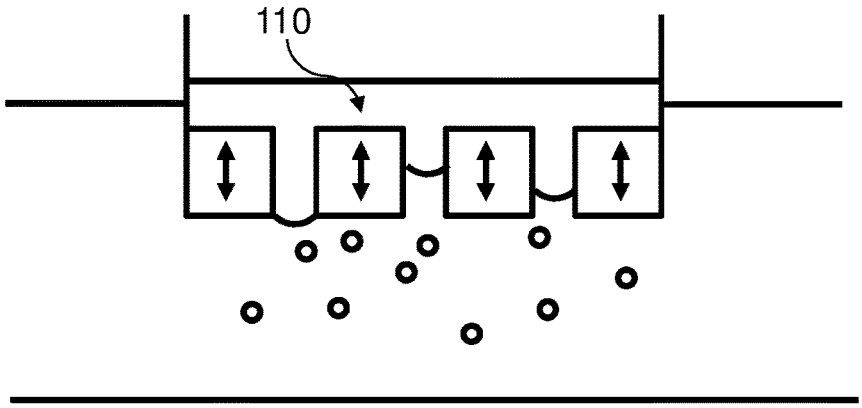
FIG. 4 represents, schematically, a particular embodiment of the membrane of the device that is the subject of the invention.

FIG. 4 shows, schematically and in cross-section, a particular embodiment of the membrane 110 of the device, 100, 300 or 400, as described with reference to FIG. 1, 2 or 3.

Figure 5:
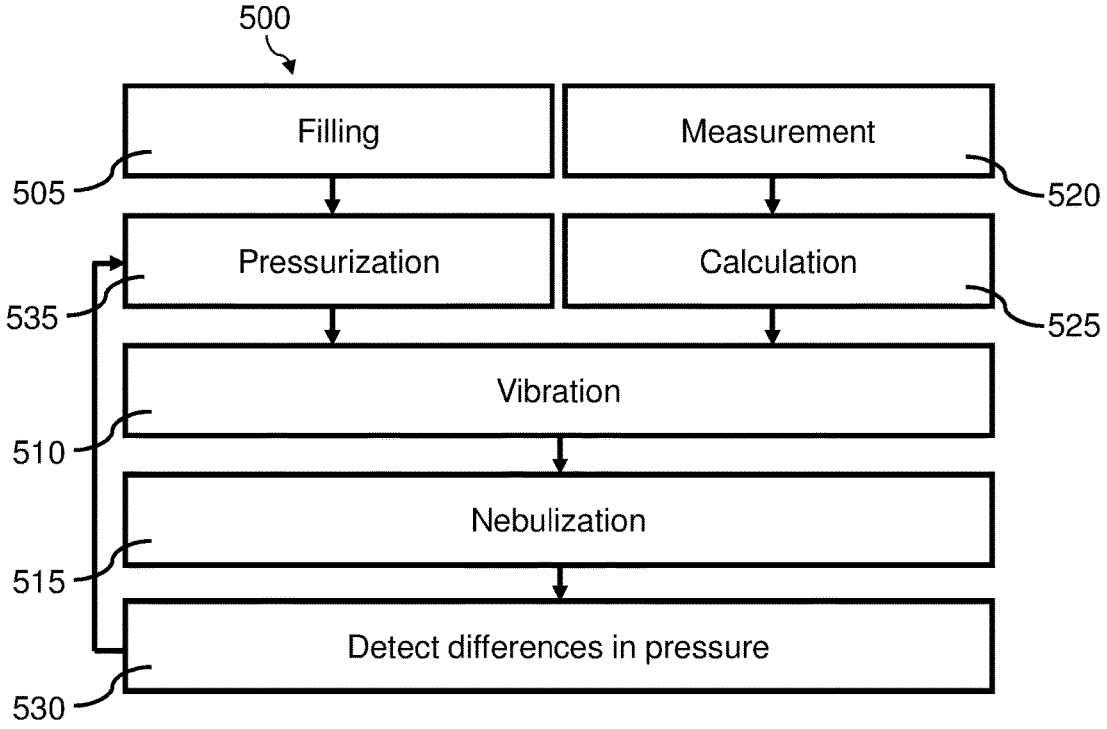
FIG. 5 represents, schematically and in the form of a logical diagram, a particular series of steps of the method that is the subject of the invention.

FIG. 5 shows, schematically, a logical diagram of particular steps of the method 500 that is the subject of the invention. This method 500 for the odorization of a gas circulating in a pipeline comprises:

- a step 505 of filling a tank with liquid odorizing compound;
- a step 510 of vibrating a microperforated membrane acting as an interface between the tank and an inner volume of the pipeline;
- a step 530 of detecting differences in pressure between the pipeline and the tank;
- a step 535 of pressurizing the compound in the tank according to the difference in pressure and/or flow rate in the pipeline; and
- a step 515 of nebulizing the odorizing compound, when it comes into contact with the membrane, in the pipeline.

As indicated above, preferably, during the step 535 of pressurizing the compound in the tank, the pressure in the tank of compound is kept below or equal to, and even more preferably strictly below, the pressure in the pipeline. The inventors have discovered that, contrary to the preconceived idea of the person skilled in the art, who uses an odorization system at a higher pressure than that of the pipeline, so as to facilitate the transfer of the odorizing compound from the tank to the pipeline, a lower pressure in the tank than that of the pipeline is favorable to achieving the odorization envisaged.

Preferably, during the step 535, the pressure inside the tank is coupled to the gas flow rate in the pipeline. The pressure difference is therefore, in absolute value, a decreasing function of the gas flow rate in the pipeline. This reduction in pressure difference in the tank of odorizing compound when the flow rate increases allows good regulation of the level of compound in the gas. In addition, the large pressure difference when the flow rate is zero makes it possible to reduce, even prevent, the passage of the odorizing compound.

The last four paragraphs of the description give examples of preferred values for the pressure difference between the tank of odorizing compound and the pipeline.

In some preferred embodiments, such as that shown in FIG. 5, the method 500 comprises:

- a step 520 of measuring the gas flow rate in the pipeline; and
- a step 525 of calculating a quantity of odorizing compound to be nebulized as a function of the flow rate measured, the vibration step 510 being performed as a function of the quantity calculated.

This method 500 is implemented, for example, by one of the devices, 100, 300 or 400, as described with reference to FIGS. 1, 2 and 3.

FIG. 6 shows, schematically, simplified and in cross-section, a particular embodiment of the device, 100, 300 or 400, that is the subject of the invention. This simplified representation shows the tank 105, a sensor 140 of differences in pressure, a pressurization means 135, and the pipeline 200 as described with reference to FIGS. 1 to 3.

In this embodiment, the pressurization means 135 is an electronic control circuit configured to command the introduction of a fluid in the tank 105 or the extraction of a portion of the fluids contained in this tank 105.

Preferably, the means 135 for pressurizing the compound keeps the compound at a pressure below or equal to, and even more preferably strictly below, the pressure in the pipeline 200.

In the particular example represented in FIG. 6, the device 100 comprises a vent 605 connected to the tank 105, the opening and closing of this vent 605 being controlled by the pressurization means 135 as a function of the pressure difference.

Therefore, for example, when the pressure in the tank 105 is higher than the pressure in the conduit 200, or when the pressure in the tank 105 is lower than the pressure in the conduit 200 by a margin smaller than a predefined margin, the pressurization means 135 commands the evacuation of a portion of the fluid contained in the tank 105.

This evacuation is achieved, for example, by the temporary opening of a solenoid valve positioned on a conduit 610 connecting the tank 105 to the vent 605. The pressure in the tank 105 being preferably higher than atmospheric pressure, the fluid flows from the tank 105 to the vent 605. This is kept open until the pressure difference meets the pressure conditions mentioned above. Such an example of reducing the pressure in the tank 105 is shown in FIG. 7.

Preferably, the link between the tank 105 and the conduit 610 being achieved by an opening 615 positioned on an upper portion of the tank 105 so as to be positioned with regard to a gaseous phase contained in the tank 105. This gaseous phase can be the result of the evaporation of the odorizing compound or the presence of gas from the pipeline 200.

In some variants, such as those shown in FIGS. 6 to 8, the device 100 comprises a gas conduit 620 connecting the pipeline 200 to the tank 105, the opening and closing of this conduit being controlled by the pressurization means 135 as a function of the pressure difference.

Therefore, for example, when the pressure in the tank 105 is lower than the pressure in the conduit 200 by a larger margin than a predefined margin, the pressurization means 135 commands the injection of gas from the pipeline 200 into the tank 105.

This injection is achieved, for example, by the temporary opening of a solenoid valve positioned on a conduit 620 connecting the tank 105 to the pipeline 200. The pressure in the tank 105 being lower than the pressure of the pipeline 200, the fluid flows from the pipeline 200 to the tank 105. This is kept open until the pressure difference meets the pressure conditions mentioned above. Such an example of reducing the pressure in the tank 105 is shown in FIG. 8.

In some preferred embodiments, such as those represented, the sensor 140 of differences in pressure detects a pressure difference between the interior of the conduit 620 connecting the pipeline 200 to the tank 105 and the conduit connecting the tank to the vent 605.

In some preferred embodiments, such as those represented, the means 135 for pressurizing the compound keeps the compound at a pressure at least 50 millibars below the pressure of the pipeline.

In some preferred embodiments, such as those represented, the means 135 for pressurizing the compound keeps the compound at a pressure at least 100 millibars below the pressure of the pipeline.

With regard to the differences in pressure between the tank and the gas pipeline, the value of at least 100 mbar can be used. Preferably, a pressure difference of at least 200 mbar, and even more preferably at least 300 mbar, is used. Preferably, this pressure difference is less than 500 mbar and, preferably, less than 400 mbar.

In steady state (ie when the gas flow rate is constant over a certain length of time), a negative pressure difference of 100 mbar enables good odorization. It is noted that a pressure difference of 50 mbar, or a pressure difference of zero, may also be suitable, in certain cases.

The invention claimed is:

1. Device (100, 300, 400) for the odorization of a gas circulating in a pipeline (200), comprising:

a tank (105) for a liquid odorizing compound;

a pressure differential detector (140) for detecting pressure differences between pressure of gas in the pipeline (200) and pressure of the liquid odorizing compound in the tank;

a pressurizer (135) for pressurizing the liquid odorizing compound in the tank according to the pressure differences;

a microperforated membrane (110) acting as an interface between the tank and an inner volume (115) of the pipeline; and an oscillator (120) for vibrating the microperforated membrane in order to spray the liquid odorizing compound, when it comes into contact with the microperforated membrane, into the pipeline.

2. Device (100) according to claim 1, wherein the pressurizer (135) for pressurizing the liquid odorizing compound keeps the liquid odorizing compound at a pressure below or equal to the pressure of the gas in the pipeline (200).

3. Device (100) according to claim 1, wherein the pressurizer (135) for pressurizing the liquid odorizing compound keeps the compound at a pressure below the pressure of the gas in the pipeline (200).

4. Device (100) according to claim 1, which comprises a connector for coupling the pressure inside the tank to a gas flow rate in the pipeline.

5. Device (100) according to claim 4, wherein the connector is configured so that the pressure difference is, in absolute value, a decreasing function of the gas flow rate in the pipeline.

6. Device (100) according to claim 1, which comprises a vent (605) connected to the tank (105), having opening and closing wherein the opening and closing of this vent being controlled by the pressurizer (135) as a function of the pressure difference.

7. Device (100) according to claim 6, which comprises a conduit (610) connecting the vent (605) to the tank (105), a link between the tank and the conduit being achieved by an opening (615) positioned on an upper portion of the tank so as to be positioned with regard to a gaseous phase contained in the tank.

8. Device (100) according to claim 1, which comprises a gas conduit (620) connecting the pipeline (200) to the tank (105), wherein opening and closing of this conduit being controlled by the pressurizer (135) as a function of the pressure difference.

9. Device (100) according to claim 6, wherein the detector (140) for detecting differences detects a pressure difference between an interior of the conduit (620) connecting the pipeline (200) to the tank (105) and the conduit connecting the tank to the vent (605).

10. Device (100) according to claim 1, wherein the pressurizer (135) for pressurizing the compound keeps the compound at a pressure at least 50 millibars below the pressure of the gas in the pipeline.

11. Device (100) according to claim 10, wherein the pressurizer (135) for pressurizing the liquid odorizing compound keeps the liquid odorizing compound at a pressure at least 100 millibars below the pressure of the gas in the pipeline.

12. Device (100, 300, 400) according to claim 1, which comprises:

a sensor (125) measuring gas flow rate in a pipeline; and a calculator (130) for calculating quantity of odorizing compound to be nebulized as a function of the gas flow rate, the oscillator (120) being configured to vibrate the membrane (110) as a function of the quantity of odorizing compound.

13. Device (100, 300, 400) according to claim 1, which comprises a measurer (106) for measuring the temperature of the liquid odorizing compound and/or the gas, the oscillator (120) being actuated as a function of the temperature.

14. Device (100, 300, 400) according to claim 1, which comprises a measurer (107) for measuring concentration of the liquid odorizing compound downstream from the membrane (110), the oscillator (120) being actuated as a function of the concentration.

15. Device (100) according to claim 1, which comprises a flowmeter (151) measuring flow rate of the liquid odorizing compound passing through a conduit (150) supplying the tank (105) with liquid odorizing compound.

16. Device (300) according to claim 1, which comprises:

a detector (355) of a malfunction of the device; and a mechanism (360) for closing a conduit supplying the tank with liquid odorizing compound.

17. Device (100, 300, 400) according to claim 1, wherein the oscillator (120) is a piezoelectric crystal.

18. Device (100, 300, 400) according to claim 17, wherein the oscillator (120) and the membrane (110) are one and the same.

19. Device (100, 300, 400) according to claim 1, which comprises a filter (165) on a conduit (150) supplying the tank (105) with odorizing compound.

20. Device (100, 300, 400) according to claim 1, which comprises a tube (470) or sleeve comprising each membrane (110) and connected to the tank (105) such that the liquid odorizing compound comes into contact with each membrane.

21. Method (500) for the odorization of a gas circulating in a pipeline, comprising:

a step (505) of filling a tank with liquid odorizing compound;

a step (530) of detecting pressure differences between pressure of gas in the pipeline and pressure of the liquid odorizing compound in the tank;

a step (535) of pressurizing the liquid odorizing compound in the tank according to the pressure differences;

a step (510) of vibrating a microperforated membrane acting as an interface between the tank and an inner volume of the pipeline; and a step (515) of nebulizing the liquid odorizing compound, when it comes into contact with the membrane, in the pipeline.

* * * * *